United States Patent [19]

Pyzytulla

[11] Patent Number: 5,018,642

[45] Date of Patent: May 28, 1991

[54] VESSEL

[75] Inventor: Dietmar R. Pyzytulla, Kerpen, Fed. Rep. of Germany

[73] Assignee: Mauser-Werke GmbH, Bruehl, Fed. Rep. of Germany

[21] Appl. No.: 511,490

[22] Filed: Apr. 19, 1990

Related U.S. Application Data

[63] Continuation of Ser. No. 324,289, Mar. 15, 1989, abandoned.

[30] Foreign Application Priority Data

Jul. 16, 1988 [DE] Fed. Rep. of Germany ..... 3824176

[51] Int. Cl.[5] ..... B65D 88/12; B65D 88/08

[52] U.S. Cl. ..... 220/675; 220/649

[58] Field of Search ..... 220/604, 605, 606, 659, 220/675, 649

[56] References Cited

U.S. PATENT DOCUMENTS

| | | | |
|---|---|---|---|
| 3,516,571 | 6/1970 | Roper | 220/74 |
| 4,094,432 | 6/1978 | Zilbert | 220/70 |
| 4,228,911 | 10/1980 | Hammes | 220/72 |
| 4,643,323 | 2/1987 | Schutz | 220/74 |
| 4,674,648 | 6/1987 | Przytulla | 220/72 |

FOREIGN PATENT DOCUMENTS

| | | | |
|---|---|---|---|
| 2600829 | 8/1977 | Fed. Rep. of Germany | 220/72 |

*Primary Examiner*—Stephen Marcus
*Attorney, Agent, or Firm*—Pennie & Edmonds

[57] ABSTRACT

Vessel of thermoplastic material having a rolling ring projecting from the shell of the vessel near the bottom of the vessel, which ring has the approximate cross-sectional shape of the trapezoid whose narrowest point is located at the bottom of the groove of the ring and whose axial end face ends in the plane of the bottom head of the vessel.

5 Claims, 1 Drawing Sheet

FIG. 2
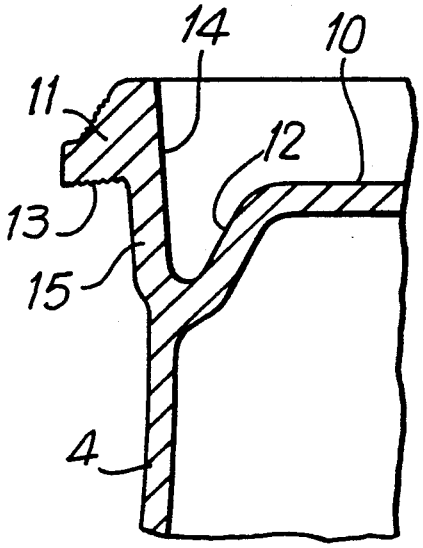
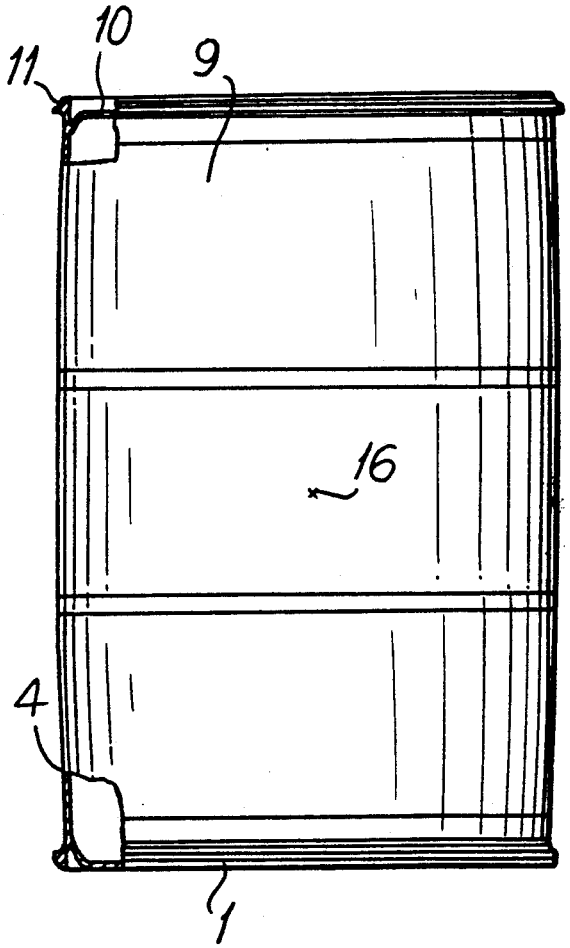
FIG. 1
FIG. 3
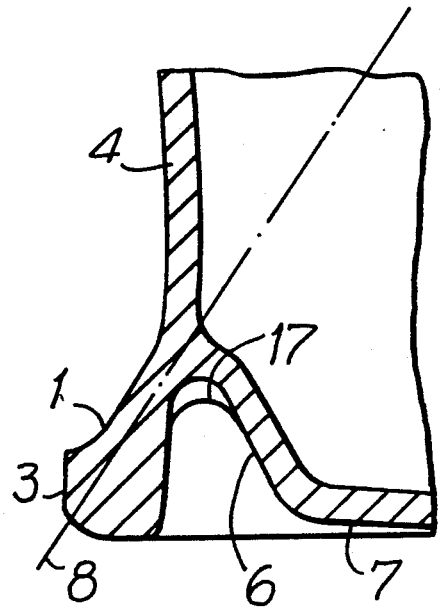

VESSEL

This is a continuation of application Ser. No. 07/324,289, filed Mar. 15, 1989, now abandoned.

BACKGROUND

The invention relates to a vessel of thermoplastic material having a rolling ring projecting in axial prolongation of the cylindrical portion of the shell near the head, wherein the adjoining shell region from the bottom of the groove between ring and shell makes a conical transition into the head.

Conventionally, such vessels are equipped with cross-sectionally massive carrying and transport rings located in the neighborhood of the associated end surfaces, the rings having a horizontal and a vertical bearing surface for the arms of a vessel-handling lifter.

As a rule, these vessels are drums manufactured in their entirety by a blowing operation, the carrying and transport rings being formed in one piece with the shell in the process. However, there are other known vessels in which the tubular portion of the shell and the end portions are produced separately. The injection-molded heads with carrying and transport rings in place are welded to the tubular body of the vessel in an additional operation.

Because the carrying and transport rings are much endangered, owing to their comparatively small shell thickness, in event of oblique impact of a full vessel falling from some height, the position of the rings must be preceded by a so-called crumple zone in which the main energy of impact will be absorbed. This is done by arranging the rings at an interval beyond the head and/or bottom edges of the vessel. The shell regions extending beyond the ring groove rise conically towards the centerline of the vessel.

In oblique or perpendicular impacts of the falling vessel, the elastic end regions lying inside the rings undergo deformation before the rings are reached. Owing to the comparatively short distance of the rings from the head and/or bottom of the vessel, the operator rolling the vessel obliquely can grasp the rings with the hand, so that an extremely convenient handling results.

In oblique rolling of the full vessel, the edge of the head is pressed in flat by the weight of the vessel, with an undesirable wobbling action as the vessel is rolled. By bracing the carrying and transport ring in question against the head, the deformation of the head edge may be partly cushioned, thus mitigating the unwanted wobbling action.

Nevertheless there is still a marked impediment to the rolling of the vessel on the bottom edge. Furthermore, the edge region at the transition of the shell of the vessel into the head is comparatively thin, and may be overstrained in rough handling, especially in oblique rolling by hand. Besides, the danger of accident when tilting and rolling the vessel is heightened by the erect rolling ring, which may come down on the operator's foot.

SUMMARY OF THE INVENTION

Since essentially it is only the upper carrying and support ring that provides the abutment for a lifter, whereby the vessel is lifted and transported, the other carrying and transport ring is available to be modified for a different function. In so doing, however, it must not be forgotten that the deforming stresses when a full vessel is dropped should be non-destructively cushioned.

For this purpose, the bottom carrying and transport ring is to be converted into a rolling ring and occupy a somewhat different location on the shell of the vessel.

This is done, according to the invention, in that the rolling ring has the approximate cross-sectional shape of a trapezoid whose narrowest point is located in the bottom of the groove of the ring, and thence rises into the thickened end region of the ring, and the axial end face of the ring ends in the plane of the head of the vessel.

Thus it may be seen that the bottom crumple zone has been retracted, so that the vessel can be rolled along only on the rolling ring.

The energy of impact generated upon oblique or perpendicular impact of a falling vessel is absorbed directly in the rolling ring, which creases inward about its narrow connection to the shell of the vessel and is thus elastically deformed, until it meets the conical portion of the shell and is there braced. In this way the impact energy is absorbed by the deforming ring.

Vertical stacking loads are assumed by the rolling ring and by the bottom head of the vessel, there being a distribution of forces into the ring by way of the cylindrical part of the shell and into the bottom head by way of the conical part of the shell. The end surface of the bottom of the vessel may be slightly set back from the axial end face of the rolling ring, to achieve a snug seating on the floor surface.

When the erect vessel is being rolled, it is slightly inclined. The diagonal load transmitted by way of the edge in rolling may be better absorbed, according to the invention, in that the rolling ring is slightly inclined outward beginning at the bottom of the groove, the prolongation of the centerline drawn through the cross section of the ring intersecting the region of the center of gravity inside the vessel. In this way, the rolling ring is largely relieved of bending stresses while rolling along, so that owing to the lesser extent of the deformation, a comparatively confined area of contact is achieved, favorable to the rolling operation. Stacking loads are transmitted directly into the shell of the vessel by way of the rolling ring.

If, in elaboration of the invention, the outside diameter of the radial end surface of the rolling ring matches the diameter of the circumference of the shell of the vessel, an efficient palleting of the vessel is made possible.

BRIEF DESCRIPTION OF THE DRAWINGS

FIG. 1 shows a side view of a bunged vessel;

FIG. 2 shows an enlarged portion of the top head of the vessel; and

FIG. 3 shows an enlarged portion of the bottom head of the vessel.

In the drawing, 4 designates the cylindrical portion of the shell of the vessel 9, 10 the top head face, and 7 the end face of the bottom head. The top head comprises bung holes, not shown.

Near the top head of the vessel is located the cross-sectionally massive carrying and transport ring 11 with a horizontal bearing surface 13 and a vertical bearing surface 14 for the arms, not shown in the drawing, of a handling lifter.

The carrying and transport ring 11 is made in one piece with the shell 4 by way of a transition ring 15 adjoining the horizontal bearing surface 13. The bottom of the groove between the transition ring 15 and the shell portion 12 rising conically to the end region 10 of the vessel is arranged, in the embodiment shown by way of example, at a distance below the horizontal bearing surface 13 of the carrying and transport ring 11.

The rolling ring 1 in the region of the bottom head of the vessel has the approximate cross-sectional shape of a trapezoid The narrowest or sharpest point of the rolling ring 1 is located in the bottom of the groove 2. In addition to the better weldability of the material, compressed in the process of manufacture, a sort of hinge is created here, about which the ring 1 can crease inward in response to laterally impinging stresses. From this narrowest point, the ring 1 rises into its thickened end region.

The axial end face 5 of the ring 1 ends about in the plane of the bottom head 7 of the vessel, making a transition by way of the conical portion 6 into the cylindrical portion 4 of the shell. The radial end surface 3 is equal to the diameter of the circumference of the shell 4.

The rolling ring 1 is slightly inclined conically outward beginning from the bottom of the groove 2. The prolongation of the dot-dash centerline 8 drawn through the cross section of the ring intersects the region of the center of gravity 16 of the vessel 9. The ring is reinforced by evenly spaced axial ribs 17 at its narrowest cross section in the inner and outer peripheral regions.

I claim:

1. A thermoplastic vessel with a rolling ring protruding from the shell of the vessel near the bottom thereof in axial extension of the cylindrical shell and in which the shell area adjoining the base of a groove between the rolling ring and shell conically merges into the bottom head of the vessel, characterized in that the inside wall surface of rolling ring, starting from base of the groove, merges into an axial end face which, in turn, merges with a convex arc-shaped corner surface into a radial end surface of the ring with the cross section of the rolling ring thickening, as measured further from the base of said groove and the radial end surface merges from its upper outer edge into the outside surface of drum shell by a conical outside surface facing away from the bottom head of the vessel and the prolongation of the center axis drawn through the cross-section of the ring and generally parallel to the conical outside surface thereof, intersects the vertical center axis of the vessel, when empty, centrally of its axial length.

2. The vessel according to claim 1, wherein the rolling ring in its narrowest cross-section at the base of the groove is reinforced by evenly distributed axial ribs.

3. The vessel according to claim 1 wherein the prolongation of said center axis extends through the arc-shaped corner surface of the ring.

4. The vessel according to claim 1 wherein the axial end face of the ring ends in the plane of the bottom head of the vessel.

5. The vessel according to claim 1 wherein the radial diameter of the radial end surface of the rolling ring corresponds to the largest diameter of the drum shell.

* * * * *

UNITED STATES PATENT AND TRADEMARK OFFICE
CERTIFICATE OF CORRECTION

PATENT NO. : 5,018,642

DATED : MAY 28, 1991

INVENTOR(S) : DIETMAR R. PRZYTULLA

It is certified that error appears in the above-identified patent and that said Letters Patent is hereby corrected as shown below:

In the title page of the patent, column 1, line 2, Dietmar R. Pyzytulla, should read --Dietmar R. Przytulla--.

In the title page of the patent, column 1, line 4, Dietmar R. Pyzytulla, should read --Dietmar R. Przytulla--.

Signed and Sealed this

Sixth Day of October, 1992

*Attest:*

DOUGLAS B. COMER

*Attesting Officer*

*Acting Commissioner of Patents and Trademarks*